US005421302A

United States Patent [19]

Livshits et al.

[11] Patent Number: 5,421,302

[45] Date of Patent: Jun. 6, 1995

[54] ENGINE SPEED CONTROL STATE PREDICTION

[75] Inventors: Mikhail Livshits, Southfield; Charles H. Folkerts, Troy; David J. Sanvido, Novi, all of Mich.

[73] Assignee: General Motors Corporation, Detroit, Mich.

[21] Appl. No.: 202,961

[22] Filed: Feb. 28, 1994

[51] Int. Cl.[6] ..... F02M 3/00

[52] U.S. Cl. ..... 123/339.23

[58] Field of Search ..... 123/339, 478, 416, 417, 123/438, 494; 364/431.03, 431.05, 431.07; 73/118, 118.2

[56] References Cited

U.S. PATENT DOCUMENTS 4,548,185 10/1985 Posniak ..... 123/571
5,094,213 3/1992 Dudek et al. ..... 123/478
5,253,623 10/1993 Melnyk et al. ..... 123/339
5,253,624 10/1993 Anzai et al. ..... 123/339
5,365,445 11/1994 Takizawa ..... 123/339
5,365,903 11/1994 Watanabe ..... 123/339

*Primary Examiner*—Raymond A. Nelli
*Attorney, Agent, or Firm*—Michael J. Bridges

[57] ABSTRACT

Prediction of the torque and speed of an internal combustion engine at a subsequent engine angular position at which engine control commands are to be issued include information on a steady state torque estimation in accord with a set of engine parameters, an estimated torque production delay value, and prior predictions of engine speed and torque. Correction values reflect differences between previous predicted values and corresponding measurements, when such measurements become available, such correction values being applied to refine the predictions.

8 Claims, 3 Drawing Sheets

ENGINE SPEED CONTROL STATE PREDICTION

FIELD OF THE INVENTION

This invention relates to internal combustion engine speed control and, more specifically, to state prediction applied to parameters commonly used in high performance control of engine speed.

BACKGROUND OF THE INVENTION

Robust control of internal combustion engine speed, especially speed at or near idle, persists as a particularly challenging engine control issue. Rejection of the significant engine load disturbances that frequently occur involves adjustment of the engine operating point. The adjustment must respond rapidly and in proportion to the load disturbance for proper rejection. Improper rejection can result in perceptible and annoying engine speed variation. Accordingly, it is desirable to rapidly and proportionately respond to engine load disturbances, especially at idle.

Prediction of changes in engine speed and engine torque before such changes become manifest is generally known in the art to increase the amount of time available to prepare and deliver the described appropriate adjustment to the engine operating point. Situational feedforward control has been proposed in which changes in engine speed are predicted by monitoring the status of the wide variety of actuators and engine parameters that tend to impact engine speed stability.

The difficulties with situational feedforward control are numerous. For example, a large number of signal and actuator status combinations must be calibrated and periodically analyzed to ascertain the overall impact thereof on engine speed. Compromises may be required in the sophistication of the control in order to process all of the combinations, such as quantizing or altogether ignoring the magnitude of the load change corresponding to the combinations. Common treatment for a wide range of load changes follows from such compromises, reducing the robustness of the engine speed control. Furthermore, some of the load disturbances addressed in situational feedforward control, such as load changes caused by power steering cramp, are very difficult to accurately estimate or measure. Still further, preclusively high sampling rates may be required to properly monitor rapidly changing signals or actuators.

Feedback control has likewise been applied in engine speed control, in which sensed changes in load or engine speed or engine torque may be addressed. However, the reliance of such control on sensing of the control parameters themselves can unacceptably reduce the responsiveness of the control.

Accordingly, what is needed is an engine speed control improvement that avoids the difficulties of situational feedforward control and provides for a more responsive feedback control of engine speed.

SUMMARY OF THE INVENTION

The present invention accommodates the described need through an approach to predicting engine speed control parameters that relies on a small set of relatively simple engine parameters.

Specifically, engine speed is predicted in advance of the time at which a control response to engine speed changes will be required for a precise speed control. The prediction is derived from an engine steady state torque estimate, a torque production delay estimate, and an engine speed history. Error feedback may be provided, in which a prior prediction error is applied to minimize system errors, such as bias errors or errors resulting from modelling inaccuracies.

In a further aspect of the invention, engine torque may be predicted in advance of a torque compensation time, so that appropriate compensation may be provided for any deviation away from a desired torque. The torque prediction is derived from a steady state torque estimation, a torque delivery delay estimate, and prior torque prediction values. Error feedback may be provided to increase the accuracy of the torque prediction, in which a prior prediction error may be applied to the prediction to reduce steady state errors, as may arise from system bias or modelling errors.

Accordingly, the prediction of speed and torque provided in accord with the present invention allows for a more responsive engine speed control. The available time to generate and carry out an appropriate response to predicted control parameter changes is increased. The complexities and throughput issues that inhere in conventional situational feedforward speed control are avoided. Finally, long term robustness is ensured using error feedback principles.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
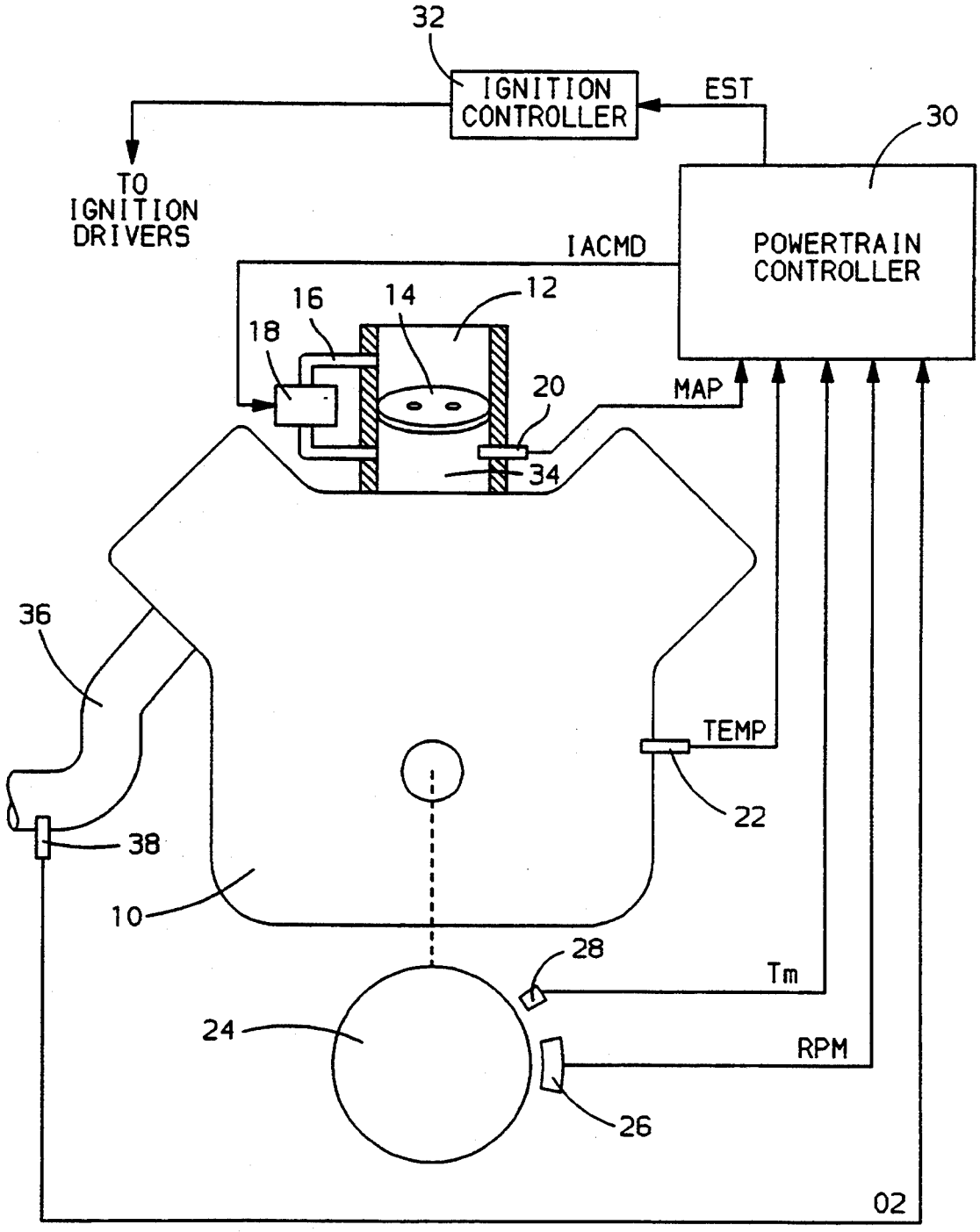
FIG. 1 is a general diagram illustrating the hardware used to carry out the present invention in accord with the preferred and alternative embodiments hereof.

Referring to FIG. 1, internal combustion engine 10 receives inlet air via inlet air path 12 in which is disposed inlet air valve 14 for metering the inlet air from inlet air path 12 to intake manifold 34. Bypass air conduit 16 provides an inlet air path around valve 14 to intake manifold 34. Idle air valve 18 is provided in conduit 16 for metering the inlet air through conduit 16 to intake manifold 34 in accord with command IACMD provided thereto. For example, idle air valve 18 may be a conventional dual position solenoid valve the position of which is controlled in accord with a fixed frequency, fixed amplitude, variable duty cycle command IACMD provided thereto so as to precisely control the quantity of inlet air provided to engine 10 while the inlet air valve 14 is at a substantially closed position at which substantially no air passes by the valve 14, such as while engine 10 is operating in an idle speed range. Conventional pressure sensor 20 is provided in intake manifold 34 for sensing the absolute air pressure therein, and for communicating an output signal MAP indicative thereof.

Engine coolant is circulated through a coolant circulation path (not shown) in which is disposed a conventional temperature sensor 22 for transducing coolant temperature and for providing an output signal TEMP indicative thereof. An engine output shaft 24 rotates through operation of engine 10 the rotational frequency of which is transduced by sensor 26 such as a conventional Hall effect sensor or a conventional variable reluctant sensor which produces periodic output signal RPM the frequency of which is proportional to the rotational speed of output shaft 24. Substantial portions of waste gasses produced through operation of engine 10 are guided out of engine cylinders and through exhaust gas conduit for conventional treatment before being passed to the atmosphere. Conventional oxygen sensor 38, such as a commercially available ZrO2 sensor is disposed in the exhaust gas conduit 36 to sense the oxygen content of the exhaust gasses passing thereby and to communicate an output signal O2 indicative thereof which, as is generally known in the art, may be used to estimate the actual engine air/fuel ratio.

Torque sensor 28 is provided on or in proximity to engine output shaft 24 to measure engine output torque and provide a signal Tm indicative thereof. For example, a preferred torque sensor in the present embodiment is the well-known and generally available Lowe Co. part no. 7530. Powertrain controller 30, which may be a conventional single chip microcontroller as is generally applied in the art of powertrain control, receives sensor output signal information, including information from signals MAP, TEMP, Tm, and RPM, and, through execution of conventional powertrain control algorithms, issues a series of powertrain control commands to various conventional engine control actuators. Among the commands issued by powertrain controller 30 is the described IACMD, for controlling the position of idle air valve 18, and electronic spark timing control command EST to conventional ignition controller 32 which responsively issues timed ignition commands to various conventional ignition drivers (not shown).

In an alternative embodiment within the scope of this invention, conventional electronic throttle control is applied to the engine 10, in which the position of inlet air valve 14 is controlled through electronic control of an actuator (not shown) that is mechanically coupled to the valve. The powertrain controller 30 issues positional commands to the actuator, which may be a well-known DC or stepper motor, which rotates in response thereto to position the valve 14 so as to provide a precise control over the degree of restriction of air passing thereby, substantially obviating the need for bypass conduit 16 and idle air valve 18.

Figure 2:
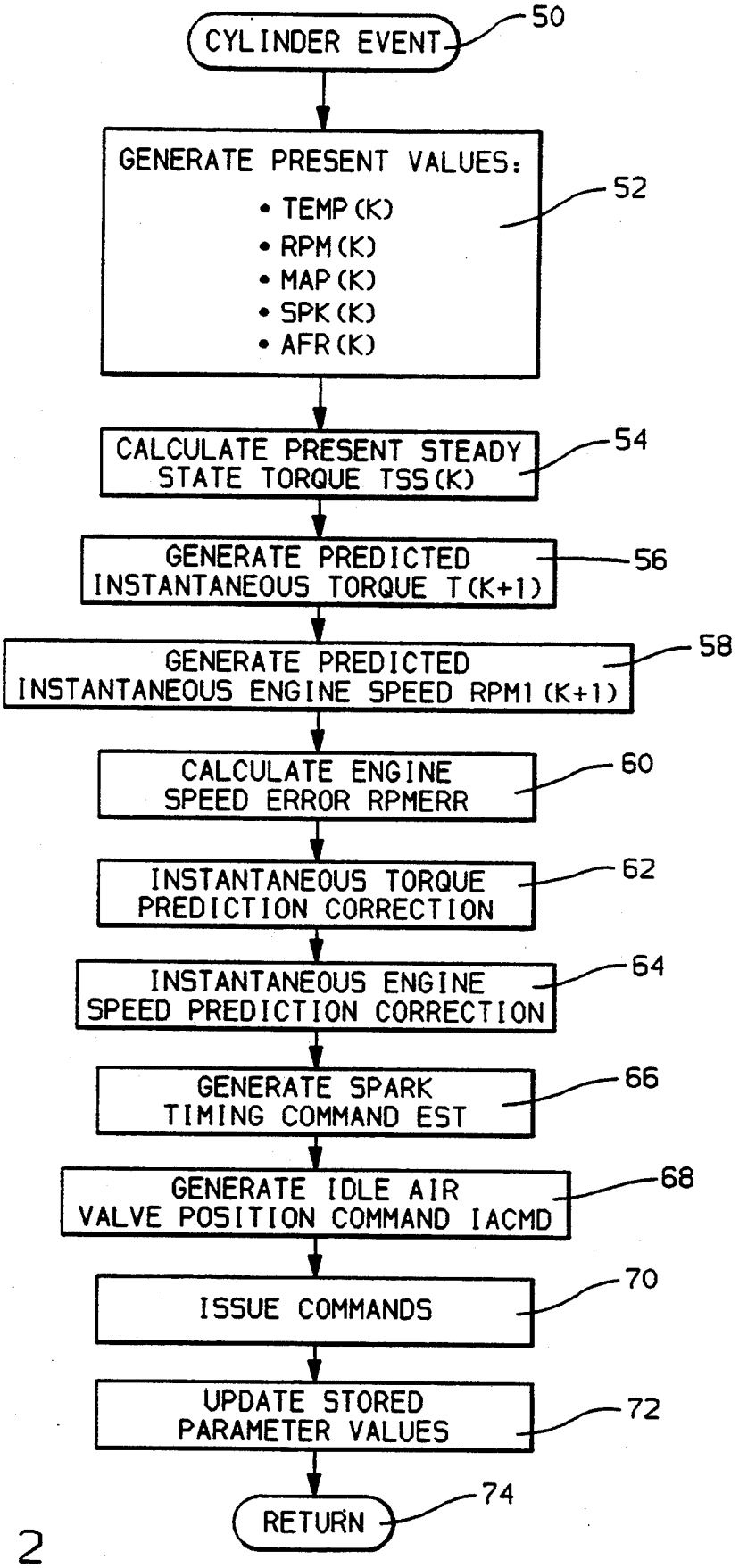
FIGS. 2 and 3 are computer flow diagrams illustrating steps used to carry out this invention in accord with the preferred and the alternative embodiment, respectively.

Among the powertrain control algorithms executed by powertrain controller 30 the routine of FIG. 2 is executed once for each sensed engine cylinder event, which may be indicated by each cycle of signal of RPM from sensor 26. Accordingly, the routine of FIG. 2 may be executed in this embodiment of the invention once for every cylinder event for each of the multiple cylinders of engine 10. In this context, a cylinder event may be defined as each cylinder torque producing event.

Upon the occurrence of each cylinder event, the routine of FIG. 2 is initiated starting at a step 50. The routine proceeds to a step 52 to generate present values, designated by the index k, for input signals. The generated present values include coolant temperature TEHP(K), engine speed RPM(K), manifold absolute pressure MAP(K), engine spark timing EST(K) and engine air/fuel ratio APR(K). The index k denotes the cylinder event to which the corresponding value is associated, with larger index values indicating more recent cylinder events. As is generally understood in the art of engine control, the present spark timing value EST(K) is determined in accord with a variety of conventional engine control goals including engine performance and emissions goals. Air/fuel ratio APR(K) is determined in response to input signal O2 which provides an indication of actual engine air/fuel ratio, as described.

After generating present values for the described engine control parameters at the step 52, the routine of FIG. 2 proceeds to a step 54 to calculate a present steady state torque TSS(K) value in accord with the following functional relationship:

$$TSS(K)=f(RPM(K), MAP(K), EST(K), AFR(K), TEMP(K)).$$

As shown, engine output torque under steady state conditions can be described as a function of engine speed, manifold absolute pressure, engine ignition advance angle, engine air fuel ratio, and engine coolant temperature. For example, a multi-dimensional dynamometer experiment with the specific engine 10 (FIG. 1) of this embodiment may provide information on the relationship of the above-described engine parameters to each other and their relative functional contribution in the discrimination of steady state torque of the engine. In such a calibration, by holding successive ones of the set of parameters constant and varying others of the set of parameters, one might arrive at a function that adequately describes the relative contribution of each to the overall determination of engine steady state torque. Such functions describing steady-state torque as a functional combination of generally-known engine parameters are well-known in the art.

After determining steady state torque at the step 54, the routine of FIG. 2 proceeds to a next step 56 at which an instantaneous torque is predicted for the next cylinder event as follows:

$$T(K+1)=at1*T(K)+at2, TSS(K)+at3*(EST(K)-EST(K-1))$$

in which T(K+1) represents a prediction of the instantaneous output torque of the engine at the next successive engine cylinder event. In general, this equation characterizes the extent to which engine dynamics, as modelled by historical information on change in engine torque away from steady-state engine torque, and on change in spark advance EST(), perturb instantaneous torque away from steady state torque. This equation was arrived at by the inventors hereof through an exhaustive analysis of engine dynamics and their impact on engine steady-state torque. The coefficients of this equation including at1, at2, and at3, take on calibration values through a conventional calibration process of the engine of this embodiment. For example, in this embodiment at1 may be set to 0.65, at2 may be set to 0.35, and at3 may be set to 0.35.

After determining T(K+1), the routine of FIG. 2 moves to a step 58 to predict an instantaneous engine speed at the k+1th cylinder event as follows:

$$RPM1(K+1)=a1*RPM(K)+a2*RPM(K-1)+a3*TSS(K-1)+a4*(EST(K)-EST(K-1)$$

in which the engine speed coefficient a1 is set to 1.91 in this embodiment, the coefficient for a previous engine speed a2 is set to −0.9 in this embodiment, the steady state torque coefficient a3 is set to 0.03 in this embodiment, and the change in spark advance coefficient a4 is set to 0.35 in this embodiment.

This instantaneous engine speed calculation includes parameter values known to be accurately measurable through conventional estimation or measurement approaches, including engine speed measurement approaches, steady state torque estimation approaches using well-developed and generally-known models, and calculations of change in spark advance. Generally, the equation of step 58 represents a model established in accord with this invention of the impact of engine steady state torque, change in spark advance, and a history of engine speed on future engine speed, through reliance on well-recognized engine dynamics principles.

After generating the predicted engine speed at the step 58, the routine of FIG. 2 proceeds to a step 60 to calculate engine speed error RPMERR as the difference between the measured engine speed RPM(K) and a prior predicted instantaneous engine speed RPM1(K) for the present cylinder event. By generating the error between the actual measured value from the highly accurate engine speed sensor and the predicted value from the previous iteration of this routine (from the service routine executed in response to the prior engine cylinder event), information is made available with which to reduce or substantially eliminate any bias errors that may be the result of finite precision coefficients or system non-linearities not accounted for in the models of this embodiment. Accordingly, the traditional benefits of closed-loop control may be realized in this prediction approach while still allowing for prediction of future engine speed and torque. As will be described, this calculated engine speed error will be applied at a subsequent step of the routine of FIG. 2 of this embodiment to improve the accuracy of the RPM prediction in accord with this invention.

After the step 60, the routine of FIG. 2 proceeds to a step 62 to correct the instantaneous torque prediction by applying the engine speed error information to the already predicted instantaneous torque value as follows:

$$T(K+1)=T(K+1)+k2*RPMERR$$

in which the coefficient kt2 is set in accord with a value determined through a conventional calibration process, such as to approximately 0.1 in this embodiment. As described, this torque prediction correction allows for feedback of actual sensed engine speed error into the prediction of torque so as to minimize the impact of bias errors and modeling inaccuracies etc. on the prediction. After correcting predicted torque at the step 62, the routine proceeds to a step 64 to correct the generated instantaneous engine speed prediction by applying information on the engine speed error generated at the step 60 to the prediction of engine speed for the next cylinder event as follows:

$$RPM(K+1)=RPM1(K+1)+kr2*RPMERR$$

in which the coefficient kr2 may be set to a value determined through a conventional calibration process, such as 0.1 in this embodiment.

After correcting the engine speed prediction at the step 64, the routine moves to generate spark timing and idle air valve position commands at the steps 66 and 68 respectively, in accord with conventional engine speed control practice, using the prediction of engine torque and engine speed provided in accord with this invention through the abovedescribed steps of FIG. 2. This prediction information may be used in accord with an engine speed control algorithm, and especially an idle speed control algorithm to more accurately and more responsively compensate for engine disturbances affecting engine torque margin and engine speed. Spark timing and idle air valve position may be adjusted in response thereto. The result is a more robust engine speed control, especially at idle, with a minimization of calibration requirements and with a minimization of throughput demands, so as to minimize the hardware and process requirements needed to provide such a robust engine speed control. In an embodiment within the scope of this invention, rather than position the idle air valve in response to the prediction information, inlet air valve 14 (FIG. 1) may be positioned to control air at idle in response to the prediction information to compensate for the engine disturbances. Such would comport with generally known principles of internal combustion engine electronic throttle control.

After generating the spark timing command of the step 66 and the idle air valve position command (or the electronic throttle position command) at the step 68 using the information on predicted engine speed at the next cylinder event and predicted engine torque at the next cylinder event, the routine proceeds to a step 70 to issue commands to the appropriate actuators in accord with well-known practice in the art. For example, the spark timing command will be issued to the ignition controller 32 (FIG. 1) in the form of an electronic spark timing command EST with which the ignition controller will generate individual ignition drive commands to drive the spark plugs (not shown) of the engine. The idle air valve position command will be issued by the controller 30 of FIG. 1 to the idle air valve 18 of FIG. 1 in the form of command IACMD which may be a pulse width modulated command, as described.

After issuing the commands at the step 70 the routine proceeds to a step 72 to update stored parameter values for the next iteration of the routine of FIG. 2. For example, the values having index k to be stored as values as having index k−1, the predicted values having index k+1 will be stored with the index of k, and so on. The storage of these values with the appropriate index is made by saving these values in storage locations in controller memory, which locations have addresses corresponding to the appropriate index variables. Thereby, as generally known in the art of electronic engine control, the values may be referenced from memory as needed in subsequent execution of the routine of FIG. 2, for example at the occurrence of the next cylinder event of the engine 10 (FIG. 1). After updating the stored parameter values at the step 72, the routine of FIG. 2 proceeds to a step 74 to return to any previous engine operations that were ongoing prior to the execution of the cylinder event interrupt service routine of FIG. 2.

Figure 3:
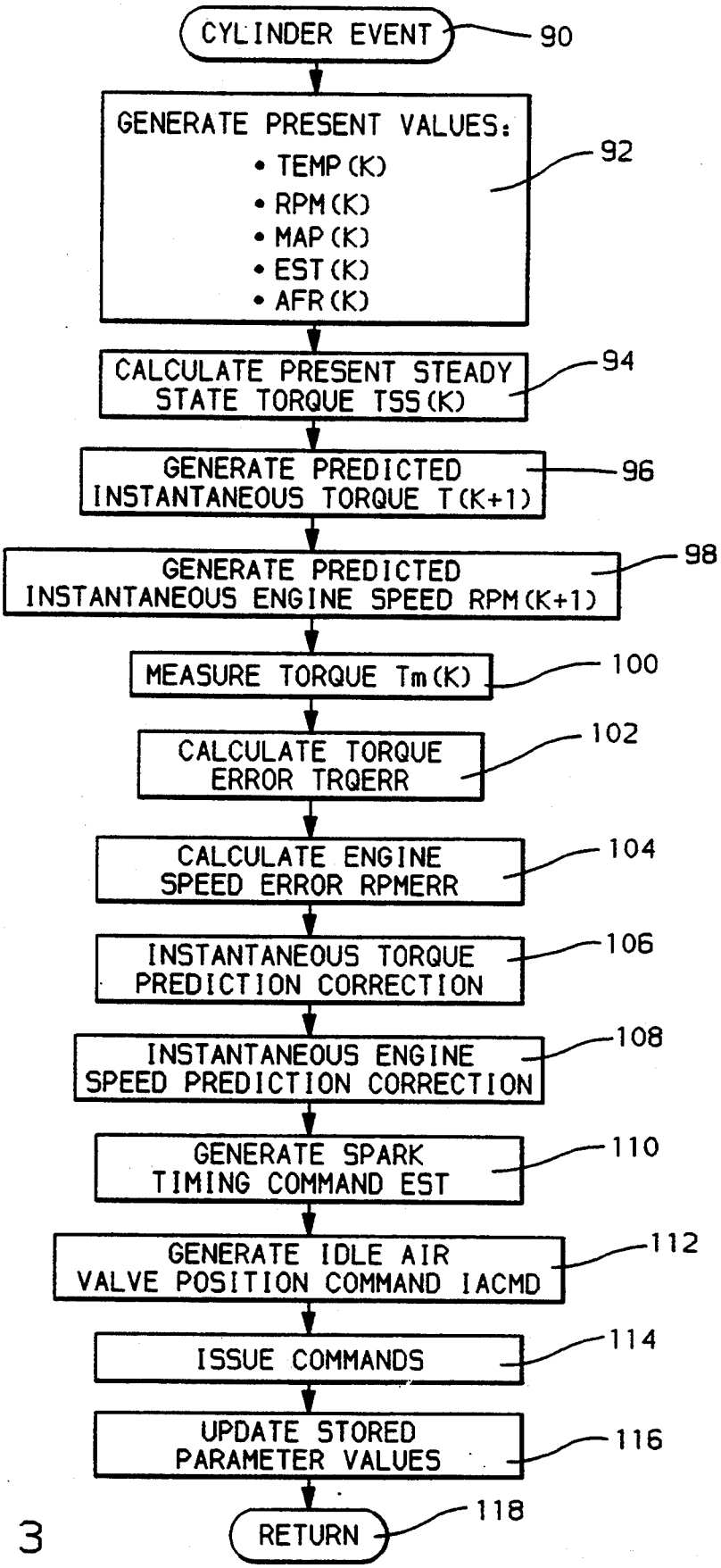

An alternate embodiment in accord with this invention is illustrated in FIG. 3, and includes the additional hardware of a torque sensor 28 (FIG. 1) having output signal Tm used for torque error feedback correction, as will be described. Generally, the routine of FIG. 3 shares many common steps with the routine of FIG. 2, and may be considered as yet another example in accord with this invention, that includes further error feedback correction so as to further improve the accuracy of the prediction of engine torque and engine speed.

Specifically, upon the occurrence of an engine cylinder event, such as was described as leading to the execution of the step 50 of the routine of FIG. 2, the routine of FIG. 3 is initiated as an interrupt service routine, for example, at the starting step 90. The routine then proceeds to a step 92 to generate present values for engine parameters used in the prediction in accord with this embodiment, for example in the manner described for step 52 of FIG. 2. The routine then proceeds to a step 94 to calculate present steady-state torque TSS(K), to a step 96 to generate a predicted instantaneous torque T(K+1), and to a step 98 to generate a predicted instantaneous engine speed RPM(K+1), all of which may be carried out as described in the routine of FIG. 2 of the prior embodiment.

The routine of FIG. 3 then proceeds to a step 100 to read the measured torque Tm(K) as output by sensor 28 (FIG. 1) for the present cylinder event. For example, the signal Tm from the sensor 28 may be an analog signal the magnitude of which corresponds to the magnitude of sensed engine output torque. It should be understood that conventional signal conditioning circuitry may be required including signal filtering and scaling circuitry through which the signal Tm passes before being read at the step 100, in accord with generally known signal conditioning practices.

After reading the measured torque Tm(K) at the step 100, the routine proceeds to a step 102 to calculate torque error TRQERR as the difference between the predicted instantaneous engine output torque T(K) for the present engine cylinder event and the measured torque Tm(K) as measured at the step 100. This torque error value will provide a basis for compensating for bias errors and errors from other conventionally known sources that can creep into open-loop control systems such as feed-forward control systems and can pollute the accuracy of such systems.

Specifically, after calculating torque error at the step 102, the routine of FIG. 3 proceeds to a step 104 to calculate engine speed error in the manner described in the routine of FIG. 2, and then proceeds to correct the predicted instantaneous torque at a step 106 as follows:

$$T(K+1)=T(K+1)+kt1*TRQERR+kt2*RPMERR$$

in which kt1 is a coefficient calibrated through a conventional calibration process as the proportional gain of the torque error term suitable to properly correct predicted torque for the error in sensed torque for the present cylinder event, and may be set to 0.05 in the present embodiment, and kt2 may be set through a conventional calibration process for the engine application to 0.1, as was described in the previous embodiment. The correction of torque for both engine speed error and measured torque error provides for a reduction or elimination of certain bias errors and other errors that can creep into nonfeedback-based engine control. Such is generally understood in the art of closed-loop engine control. After correcting the instantaneous torque prediction at the step 106, the routine of FIG. 3 proceeds to a step 108 to correct the instantaneous engine speed prediction as follows:

$$RPM1(K+1)=RPM1(K+1)+kr1*TRQERR+kr2*RPMERR$$

in which kr1 is a torque error coefficient set to a value, such as 0.05, as may be determined through a conventional calibration process as the desired proportional gain on the torque error term for a proper correction of the engine speed prediction, and the engine speed error coefficient kr2 is set in accord with a conventional calibration process as a coefficient for the engine speed error term. kr2 may be set to approximately 0.1 in this embodiment.

As was described for the case of the engine torque prediction correction of the step 106, the engine speed prediction correction of step 108 provides for a reduction or elimination of bias errors and other errors that may affect steady-state error and the stability of the control system of this embodiment, and provides certain well-known control advantages over open-loop approaches. After correcting the instantaneous torque prediction and the instantaneous engine speed prediction, the routine of FIG. 3 proceeds to a step 110 to generate a spark timing command EST in response to the instantaneous predictions and to a step 112 to generate an idle air valve position command IACMD in response to those predictions. The commands may be generated using conventionally available control practices which are responsive to some prediction of engine speed or engine torque or both. As is the case for the commands generated in the preceding embodiment, the commands generated at the steps 110 and 112 may be determined in response to an early prediction of the engine speed and the engine torque, for example, one cylinder event ahead of the time such commands would conventionally be issued to their respective actuators. As such, an opportunity is provided through these embodiments to respond both quickly and accurately to engine control disturbances that may impact engine speed and torque, to improve engine speed control robustness. Furthermore, as described in the preceding embodiment, in an embodiment within the scope of this invention including electronic throttle control of inlet air valve 14 (FIG. 1), an electronic throttle control command may be generated and issued to an actuator in response to the prediction information to position the valve for disturbance rejection.

After generating the appropriate commands responsive to the predictions at the steps 110 and 112, the routine of FIG. 3 proceeds to issue those commands at a step 114, for example in the manner described in the preceding embodiment.

The routine then proceeds to a step 116 to update the stored parameter values for use in the next iteration of this routine, which will occur upon the detection of the next engine cylinder event. Such updating may be carried out in the manner described in the preceding embodiment. The routine then proceeds to a step 118 to return to any previous operations that were ongoing prior to the interrupt that initiated the execution of the routine of FIG. 3, such as the described cylinder event interrupt.

The preferred embodiment for the purpose of explaining this invention is not be taken as limiting or restricting the invention since many modifications may be made through the exercise of skill in the art without departing from the scope of this invention.

The embodiments of the invention in which a property or privilege is claimed are described as follows:

1. A method for predicting engine speed for use in controlling operation of an internal combustion engine, comprising the steps of:

(a) measuring engine speed;

(b) sensing present values of a predetermined set of engine operating parameters;

(c) calculating engine steady state torque in accord with the sensed present values;

(d) estimating a torque production delay value representing a production delay in commanded engine torque corresponding to a predetermined future engine angular position;

(e) predicting engine speed at the predetermined future engine angular position as a predetermined function of the measured engine speed, and, from a predetermined previous engine angular position, a previous engine speed, a previous steady state torque and a previous torque production delay value; and (f) controlling operation of the engine at the predetermined future engine angular position in accord with the predicted engine speed.

2. The method of claim 1, wherein engine speed and engine torque are predicted for use in controlling operation of the engine, further comprising the step of:

predicting engine torque at the predetermined future engine angular position as a predetermined function of a previous engine torque prediction corresponding to the present engine angular position, the calculated steady state torque, and the estimated torque production delay value; and wherein the step of controlling operation of the engine controls operation of the engine in accord with the predicted engine speed and in accord with the predicted engine torque.

3. The method of claim 1, further comprising the steps of:

calculating an engine speed deviation value as a difference between a previous prediction of the engine speed corresponding to the present engine angular position and the measured engine speed; and correcting the engine speed prediction value for the predetermined future engine angular position in accord with a predetermined function of the engine speed deviation value.

4. The method of claim 2, further comprising the steps of:

calculating an engine speed deviation value as a difference between a previous prediction of the engine speed corresponding to the present engine angular position and the measured engine speed;

correcting the predicted engine speed for the predetermined future engine angular position in accord with a predetermined function of the engine speed deviation value; and correcting the engine torque prediction value for the predetermined future engine angular position in accord with a predetermined function of the engine speed deviation value.

5. The method of claim 2, further comprising the steps of:

measuring engine torque;

calculating an engine torque deviation value as a difference between a previous prediction of the engine torque corresponding to the present engine angular position and the measured engine torque;

correcting the engine speed prediction value for the predetermined future engine angular position in accord with a predetermined function of the engine torque deviation value; and correcting the engine torque prediction value for the predetermined future engine angular position in accord with a predetermined function of the engine torque deviation value.

6. An engine speed control method, comprising the steps of:

for each of a predetermined set of engine angular positions, (a) sensing a present value of a predetermined set of engine parameters;

(b) measuring present engine speed;

(c) generating a present engine steady state torque value in accord with the sensed present values;

(d) estimating a present torque production delay value corresponding to a time required for a commanded change in engine torque to produce a corresponding change in engine output torque;

(e) predicting engine torque at a predetermined subsequent engine angular position as a predetermined function of a predicted engine torque at the present engine angular position, the generated present engine steady state torque value, and the estimated present torque production delay value;

(f) predicting engine speed at the predetermined subsequent engine angular position as a predetermined function of the measured present engine speed, a measured engine speed corresponding to a predetermined prior engine angular position, a generated engine steady state torque value corresponding to the predetermined prior engine angular position, and an estimated torque production delay value for the predetermined prior engine angular position; and g) controlling engine speed at the predetermined subsequent engine angular position in accord with the predicted engine speed and predicted engine torque.

7. The method of claim 6, further comprising the steps of:

measuring engine torque for the present engine angular position;

generating a torque deviation value as a difference between the measured engine torque and the predicted engine torque for the present engine angular position;

generating a torque correction value as a predetermined function of the torque deviation value;

correcting the predicted engine torque for the predetermined subsequent engine angular position in accord with the torque correction value;

generating a speed correction value as a predetermined function of the torque deviation value; and correcting the predicted engine speed for the predetermined subsequent engine angular position in accord with the speed correction value.

8. The method of claim 6, further comprising the steps of:

generating an engine speed deviation value as a difference between the measured present engine speed and a predicted engine speed for the present engine angular position;

generating a torque correction value as a predetermined function of the engine speed deviation value;

correcting the predicted engine torque for the predetermined subsequent engine angular position in accord with the torque correction value;

generating a speed correction value as a predetermined function of the engine speed deviation value; and correcting the predicted engine speed for the predetermined subsequent engine angular position in accord with the speed correction value.

* * * * *